United States Patent [19]

Mottier

[11] 4,303,851

[45] Dec. 1, 1981

[54] PEOPLE AND OBJECT COUNTING SYSTEM

[75] Inventor: Francois M. Mottier, South Windsor, Conn.

[73] Assignee: Otis Elevator Company, Hartford, Conn.

[21] Appl. No.: 85,455

[22] Filed: Oct. 16, 1979

[51] Int. Cl.[3] ..... G06M 3/14; G07C 9/00

[52] U.S. Cl. ..... 235/92 PK; 235/92 PC; 235/92 EV; 235/92 V

[58] Field of Search ..... 235/92 PK, 92 EV, 92 PC, 235/92 TC, 92 V; 340/541, 573

[56] References Cited

U.S. PATENT DOCUMENTS

| | | | |
|---|---|---|---|
| 2,965,294 | 12/1960 | Urry | 235/92 PC |
| 3,692,980 | 9/1972 | Getker et al. | 235/92 PK |
| 3,727,034 | 4/1973 | Pope | 235/92 EV |
| 4,000,400 | 12/1976 | Elder | 235/92 EV |
| 4,009,389 | 2/1977 | Lindholm | 235/92 EV |
| 4,070,560 | 1/1978 | Blanyer | 235/92 EV |
| 4,127,766 | 11/1978 | Thayer | 235/92 PK |

*Primary Examiner*—Joseph M. Thesz
*Attorney, Agent, or Firm*—Robert E. Greenstien

[57] ABSTRACT

The perimeter of an area is scanned along two adjacent paths which define spacially resolved gates through which objects and people must pass to enter and leave the area. As the gates are scanned, the presence of objects and people are detected. A complete scan produces a gate signature which includes information indicative of the presence and location of objects and people in each gate during the scan. Successive signatures are compared in sequence as scans are made in order to determine changes caused by movement of objects and people in or out of the area. From this comparison an up/down counter is controlled to maintain a dynamic count of the number of objects or people in the area following each scan of the gates. The counter counts up as objects and people enter the area and counts down as they leave.

6 Claims, 6 Drawing Figures

TRUTH TABLE

| | 1 | 2 | 3 | 4 | 5 | 6 |
|---|---|---|---|---|---|---|
| G1 | 0 | 1 | 1 | 1 | 1 | 0 |
| G1,NEW | 1 | 0 | 1 | 1 | 0 | 1 |
| G2 | 1 | 1 | 0 | 1 | 1 | 0 |
| G2,NEW | 1 | 1 | 1 | 0 | 0 | 1 |
| COUNT | UP | DN | DN | UP | — | — |

TOO FAST

PEOPLE AND OBJECT COUNTING SYSTEM

TECHNICAL FIELD

This invention relates to systems for counting the number of objects and people within an area.

BACKGROUND ART

Probably the most common, widely used object and people counting system consists simply of an illuminating device, such as a light bulb, and a light sensitive receiver, such as a photocell. The photocell and light bulb are located at opposite sides of an entrance to the area so that as people and objects enter or leave the area they interrupt the light path between the bulb and cell, thereby modulating the cell's output. By counting the number of such interruptions absolute traffic flow is ascertained. Obviously, there are other more sophisticated variations of this perimeter monitoring system, nevertheless, all suffer from the same limitations: they cannot distinguish movement in and out of the area or if more than one person is passing through the perimeter at one time; the reason being that they provide only a zero dimensioned view of the perimeter.

It is possible to provide a perimeter monitoring system that can distinguish in and out movement. Such a system may use adjacent bulbs and cells so that as people or objects pass through, two interruptions occur in a sequence that reflects the direction of movement. Nevertheless, this system cannot distinguish side-by-side movement of objects, and, although it provides a means for ascertaining traffic flow in and out of the area monitored, it cannot be used to detect the number of people and objects in the area at any instant of time because it cannot distinguish side-by-side movement. Hence, it is simply a traffic counter.

The evolution of these systems includes the use of a TV camera located above the monitored area in order to count the number of people and objects in the area, at any instant, by counting the light or dark spots that objects standing in the area produce in the TV picture.

Indeed, such a system does not suffer from the "one dimensional" limitations of perimeter monitoring systems, nevertheless, it does present serious disadvantages; principal among these are high cost and inaccuracy. A factor contributing to the expense is that the entire TV picture must be monitored to detect the presence of objects. The inaccuracy arises from the object masking that occurs at the perimeter of the areas. People and objects substantially below the camera are seen from above and thus the area they are seen to occupy on the floor is correct. However, looking towards the perimeter the height of objects and width of objects are seen and, thus, the observed area tends to increase beyond what it actually is. Likewise, the fact that the camera is taking a "perspective" view (rather than "plan") means that an object located next to another object, but further from the camera, is masked and will not be seen. Where the floor to camera distance is small, a wide angle lens is often used to see the entire area, but that aggravates these viewing problems. Consequently, these overhead camera systems are expensive, inaccurate and often impractical, especially if used for monitoring small, wide areas from a low height, directly above the floor.

DISCLOSURE OF INVENTION

In accordance with the present invention the perimeter of the monitored area is viewed from above to detect objects and people along the perimeter. These views are made successively and preceding and successive views are compared to detect those changes in the location of objects and people manifesting their movement in and out of the area. This view is taken along two adjacent paths (inner and outer) on the perimeter and these paths define inner and outer perimeter gates, so to speak, through which objects and people must pass in order to enter and leave the area. These gates are repetitively scanned and objects or people in the paths produce changes in the scan information. Scan information having a duration corresponding to a predetermined floor distance corresponding to the average width of an object or person are considered to be a detected object or person. When an object is detected during a scan of a path, an object detection signal, having a standard time corresponding to the predetermined floor distance is generated in synchronism with the scan. The object detection signal thus identifies a path portion where an object or person (to be counted) is present. Objects and people producing information having a duration associated with a smaller floor distance are rejected and do not produce an object detection signal. During the scan of a path, object detection signals are thus sequentially generated to provide a path or gate signature identifying where objects or people are present in the path during the scan. The signature identifies side-by-side objects in the paths. These signals are stored in sequence so as to store the "signature" during its generation. The signature obtained on a successive scan of the paths is compared, at corresponding scan points, with the signatures on the preceding scans. This provides comparison between two intervals of the same portion of each path and corresponding (adjacent) portions of the inner and outer paths. From this comparison the presence of objects and their direction of movement is ascertained on a scan-by-scan basis. Noteworthy is that side-by-side movement of objects and people, in and out of the area, is detectable from this comparison and a count reflecting the instantaneous number of objects or people in the area is provided by an up/down counter.

Comparison between signatures is accomplished at intermediate points in the object detection signal because the actual position of these signals in the signature may vary from scan to scan as an object or person moves along the perimeter yet neither in or out of the area. Consequently, making this comparison at a selected "window" provides immunity from such movement which could otherwise produce erroneous counts.

In accordance with another aspect of the invention, where area size/camera to floor distance is high, perspective errors are eliminated by viewing the perimeter through a mirror; this has the effect of increasing the camera to floor distance and thus decreasing the ratio.

In contract to prior art systems the present invention provides a system which detects simultaneous side-by-side movement of objects and people into the area, but notably without the necessity for monitoring the entire area. It then becomes possible to utilize inexpensive TV cameras to provide monitoring; among such cameras are commercially available, solid-state ones that have a limited viewing area and therefore are ideally suited for the limited purpose of looking down on the perimeter along the two side-by-side regions defining the gates.

As a result, systems embodying the present invention are considerably less expensive than prior art systems attempting to achieve the same results.

BEST MODE FOR CARRYING OUT THE INVENTION

Figure 1:
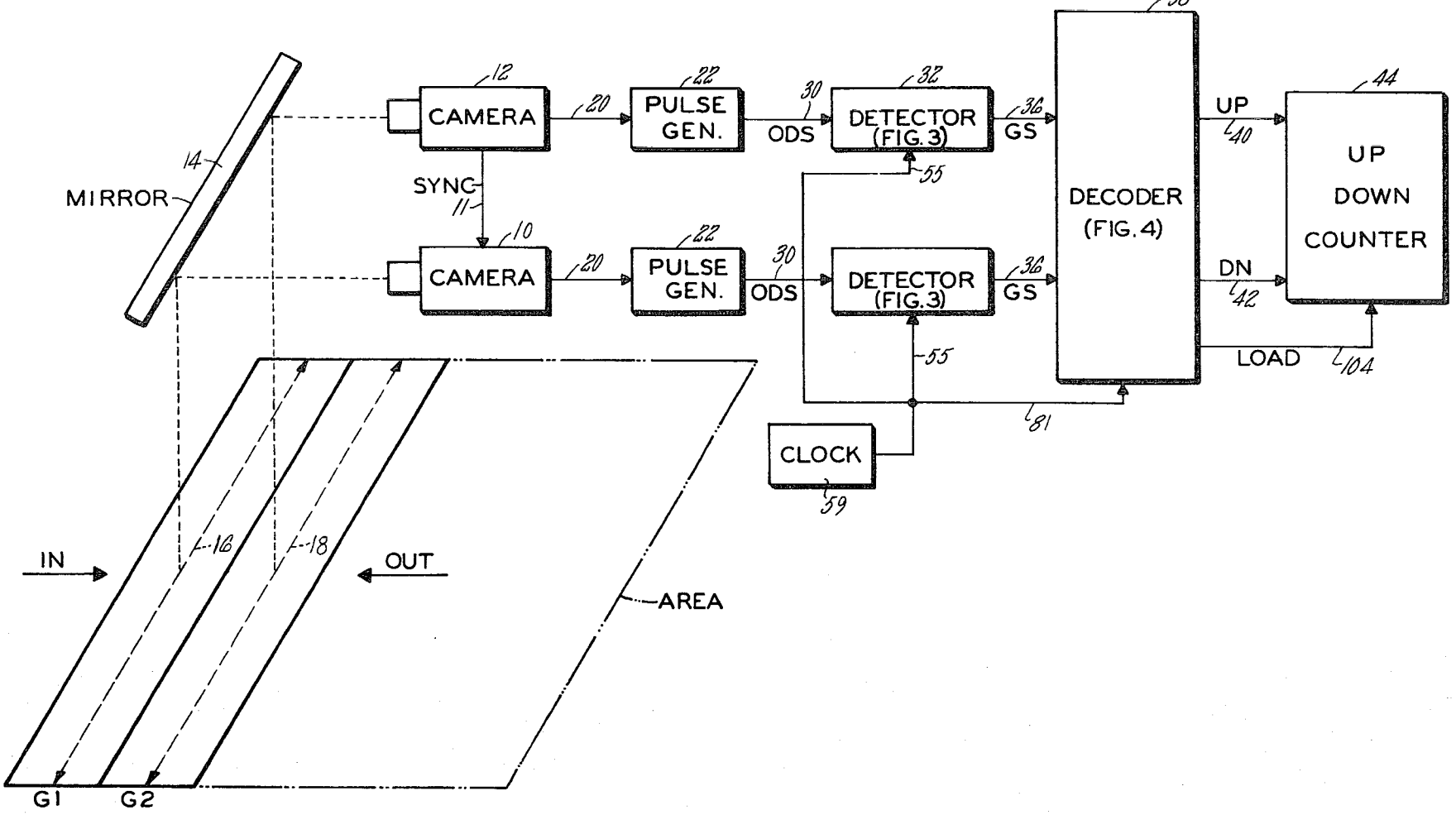
FIG. 1 is a functional block diagram of a system embodying the present invention.

FIG. 1 illustrates an area monitoring system embodying the present invention. This system employs two cameras 10, 12 and a mirror 14. The mirror is suspended over the perimeter of the monitored area, and each camera views the mirror in order to scan 16, 18 the perimeter along a path that defines two "spatially resolved" adjacent gates G1, G2 that are thereby viewed by the cameras 10, 12 respectively. Objects and people entering and leaving the area pass through the gates G1 and G2 and are thereby observed by the cameras. The purpose for the mirror is to effectively extend the camera to floor viewing distance in order to avoid the perspective difficulties frequently associated with the wide angle view when the cameras are suspended directly over the perimeter. At the edges of a wide angle view objects can mask each other; thus they may appear as a single object. The mirror eliminates the need for a wide angle lens by permitting the cameras to be located far enough away to permit use of a standard focal length lens. By doing this, masking at the beginning and end points of each scan is avoided.

Figure 2:
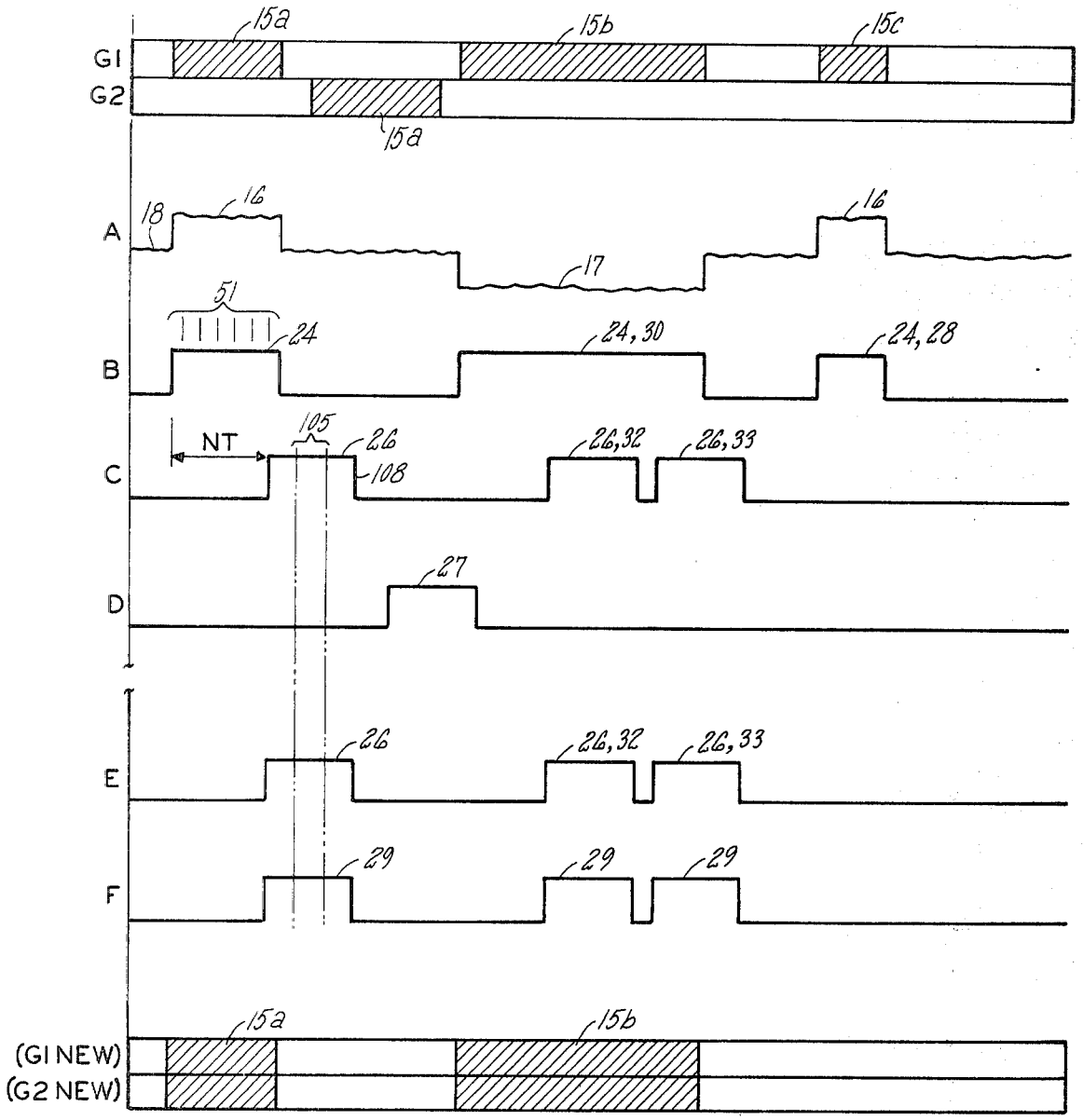
FIG. 2 is a graph containing several waveforms on a common time base.

Objects and people that enter (IN) the area pass through the gate G1 first, and then the gate G2. "Objects" hereinafter means objects and/or people. As an object moves, it masks or covers a portion of the floor directly below, thereby causing a change in the scan output from the camera when that portion is scanned. The magnitude of this change depends, of course, on whether the object or person is lighter or darker than the floor. Waveform A in FIG. 2 illustrates a single scan of the gate G1 by the camera 10, when there are objects 15*a, b, c* in the gate. An object that is lighter than the floor increases the scan output at 16, whereas as an object that is darker decreases the scan output at 17. The scan output at 18 manifests the average illumination of the floor where an object is not present. The location of these changes represents the location of the objects along the gate; their width manifests the floor space each object occupies. As described later in this description, movement of objects and people is determined by detecting these changes in successive scans. Since each scan provides a view of its associated gate along the gate's entire length, side-by-side movement of objects and people is detected.

It is assumed that the scan width of each camera covers the width of its corresponding gate; a single scan thus provides a complete view of the gate. Two cameras are shown for simplicity, yet the same functions may be provided by using a solid-state camera and imaging the gate on a single length of photosensitive material consisting of adjacent segments or blocks. Each produces an output reflecting the light from a portion of the floor, and the outputs are sequentially sensed to generate the scan. Each segment would thus correspond to a particular floor dimension. On the other hand, a conventional vidicon may require several scans to provide a complete view of each gate. The number of such scans depends, of course, on the number of scan lines and the camera's distance from the floor. A vidicon may be employed, however, by using well known techniques; an example being summing the scans obtained on each side of a gate in order to provide a complete view of the gate.

The sync output from the camera 12 is tied to the scan control of the camera 12 over a line 11 so that both gates are scanned simultaneously. Each camera produces a scan output signal (SCAN) such as that shown in waveform A for the camera 10. The scan output signal from each camera is supplied over a line 20 to a pulse generator 22. The pulse generator (i.e. a Schmidt trigger) squares ("digitizes") the scan signal by remaining high as long as the signal is above or below the signal level at 18. The pulse generator generates an object detection signal (ODS), waveform B, wherein the widths of the pulses 24 manifest the widths of the changes in the scan signal at 16 and 17. The object detection signal is supplied over a line 30 to an object detector 32 which produces gate signals (GS), waveform C, that consist of serial pulses 26 having the same width as the object detection signal. These pulses are produced by the object detection circuit if the object detection signal it receives has a width that manifests the presence of an object or person occupying a typical floor width. No such signal is generated, however, if an object detection signal is less than this typical width. For example, the signal 28 in waveform B does not produce a gate signal in waveform C. If the object detection signal 24 is at least twice this typical width (i.e. at 30), however, the object detection circuit considers this to be two objects side-by-side and two sequential gate signals 32, 33 are produced. The delay between waveforms B and C results from the fact that the gate signals are generated after a complete object detection signal is analyzed by the detection circuit. As explained in more detail later herein, the detection circuit for each camera generates a gate "signature" consisting of pulses produced as the scans are made; this signature reflects the presence of objects and people in the gate during the scan.

The gate signal produced by each detector is supplied over a line 36 to a decoder circuit 38. The decoder compares the gate signals produced by the cameras on successive scans ("old" and "new"); that is, the gate signals produced on a first scan (G1 old, G2 old) by each camera compared with the gate signals produced on the next successive scans (G1 new, G2 new). The comparison reveals movement, including direction, of objects and people across the gates. The decoder provides an up or down count over corresponding lines 40, 42 to an up/down counter 44 as movement is detected. The up/down counter thus maintains a dynamic count (scan to scan) of the number of objects and people in the area at any instant of time.

In FIG. 2, the gate signals 26 in waveform C represent the presence of two objects $\mathbf{15}_a$, $\mathbf{15}_b$ "countable" as three objects in the gate G1 (one for the object $\mathbf{15}_a$ and two for the wide object $\mathbf{15}_b$). The gate signal in waveform D represents the gate signal 27 associated with the gate G2, wherein one object $15_a$ is present. Waveforms E, F illustrate the successive gate signals for the gates G1, G2 as the two objects $15_a$, $15_b$ subsequently move into the gate G2 and the object $15_b$ leaves the gate G2 (to enter the area). The gate signals 29 for the gate G2 correspond with the signals 26 to manifest the presence of the two objects. Waveforms C and D thus manifest "old" scans and waveforms E and F manifest "new" scans. Each waveform C–F is a gate signature manifesting the presence of objects. By comparing these signatures in the decoder, in the manner described later herein, movement is determined.

Figure 3:
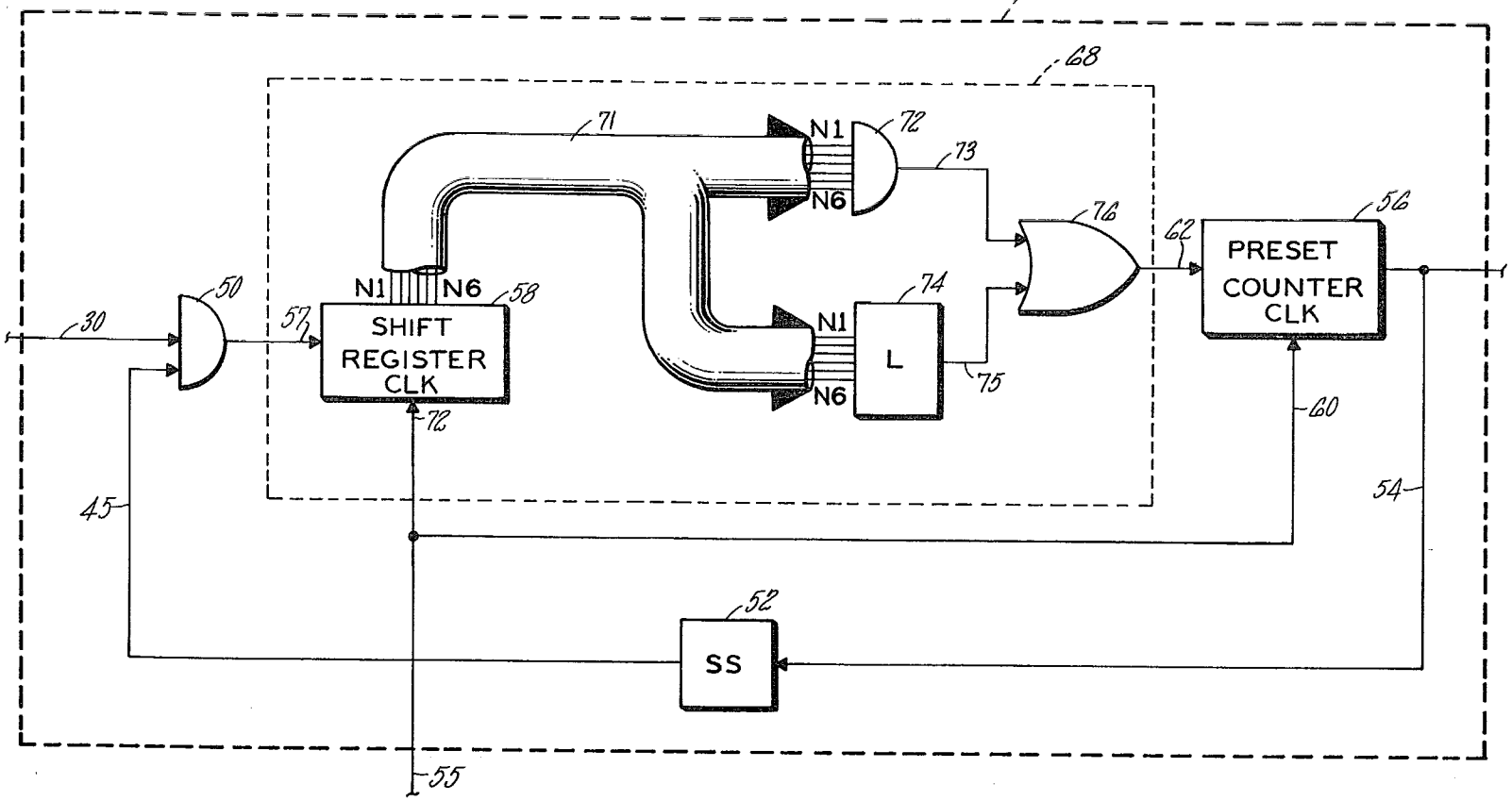
FIG. 3 is a functional block diagram of an object detector subsystem in the system shown in FIG. 1.

In FIG. 3 one of the two identical detectors 32 is shown in more detail. The object detection signal is supplied over the line 30 to one input of a gate 50 whose other input is connected over a line 45 to the output of a monostable (SS) 52. The input of this monostable is connected over a line 54 to the output of a preset counter 56. The monostable is triggered when the line 54 first goes high, which happens on the first count output from the counter 56. The output of the gate 50 is coupled over a line 57 to the input of a shift register 58. When the monostable is triggered, transmission of the gate signals to the input of the shift register is blocked because both of the gate inputs are not high. Clock pulses on a line 55 (CLK) from a system clock 59 (See FIG. 1) are supplied over a line 60 to the clock input of the counter 56. The counter 56, which may be an automatically resetting shift register, receives binary signals at its input over a line 62 from the output of a subcircuit 68. On each clock pulse the binary signal on the line 62 appears at the output of the counter 56 and therefore on the line 54 that couples the output to the monostable 52. The counter 56 transfers these signals for a preset number of clock pulses and thus generates a binary word on the counter output. The word length equals the aggregate duration of the preset number of clock pulses. For example, the clock may be preset to count six clock pulses; thus it generates a six-bit binary word. This word thus reflects the output from the subcircuit 68 during the time interval of six clock pulses. Since the interval corresponds to a particular scan distance along the perimeter, it also corresponds to a particular floor distance.

The subcircuit 68 determines if the object detection signal on the line 30 is sufficiently wide (in terms of time) to correspond to an object or person that should be counted. Each time a clock pulse, from the system clock, is applied over a line 72 to the clock (CLK) input of the shift register 58, the instantaneous output from the gate 50 is loaded into the shift register 58. The instantaneous object detection signal 24 is thus sequentially loaded into the shift register, thereby establishing a binary word consisting of the number of bits in the shift register parallel output; for example, six bits (N1–N6). This word (N1–N6) represents the object detection signal level at six successive intervals 51 or sample points; thus six points along the scan, since each clock pulse corresponds to a portion of the scan which, in turn, corresponds to a floor dimension. Therefore, the word (N1–N6) represents a particular floor dimension (W), determined by the size (N) of the word (number of bits), the time (T) of the clock pulses and the scan distance/clock pulse (S) according to the equation: $W=NTS$. N, T and S are selected so that W equals the width of an average object or person to be counted. The stored word (N1–N6) in the shift register is supplied, in parallel over lines 71, to a gate 72 and a logic circuit 74. These determine if the word is "long enough": if it contains a sufficient number of high bits to represent the typical object. The gate 72 output, on a line 73, goes high if N1–N6 are all high; the logic circuit 74 output, on a line 75, goes high if all but one of N1–N6 are high. The output from the gate 72 and the logic circuit 74 are supplied to a gate 76 whose output, on the line 62, goes high if the output of either the gate 72 or logic circuit 74 is high; this transmits the word (N1–N6) stored in the shift register to the gate 62. As described previously, the word is then supplied to the input of the preset counter 56 which produces a serial binary word (gate signal), preferably having an equal number of bits (six, for example). That word corresponds to the same floor dimension as N1–N6 because the clock pulses supplied to the present counter and the shift register are the same (from the system clock 54). Obviously, one of the bits N1–N6 can be low due to noise or other factors producing a change in the scan signal. Any missing bit in N1–N6 is included by the logic circuit 74.

The monostable 52 functions to separate a long duration object detection signal (i.e. signal 30 in waveform B). The monostable thus temporarily interrupts the entry of this signal 30 into the shift register 50. This occurs after a complete word (corresponding to an object) is generated by the counter 56. If the signal is long enough (at least twice the width of the gate signal word) it will produce another word 32 after the single shot returns to its high state. However, if the signal 30 is less than twice the width of the gate signal word, the data loaded into the shift register after the single shot goes high will not be sufficient to cause the output of either the gate 72 or the logic circuit 74 to go high; the preset counter thus will not produce an output. Referring to waveforms B and C, this accounts for the absence of a corresponding gate signal word in waveform C from the short gate signal 28 in waveform B. As mentioned previously, there is a delay between waveforms B and C, between receipt of the object detection signal by the detector and generation of the gate signal. This happens because the incoming data (waveform B) must be loaded into the shift register after six clock pulses, thereby causing a delay which equals NT, the product of the time (T) of each clock pulse and the number of bits (N) in the word N1–N6.

Figure 4:
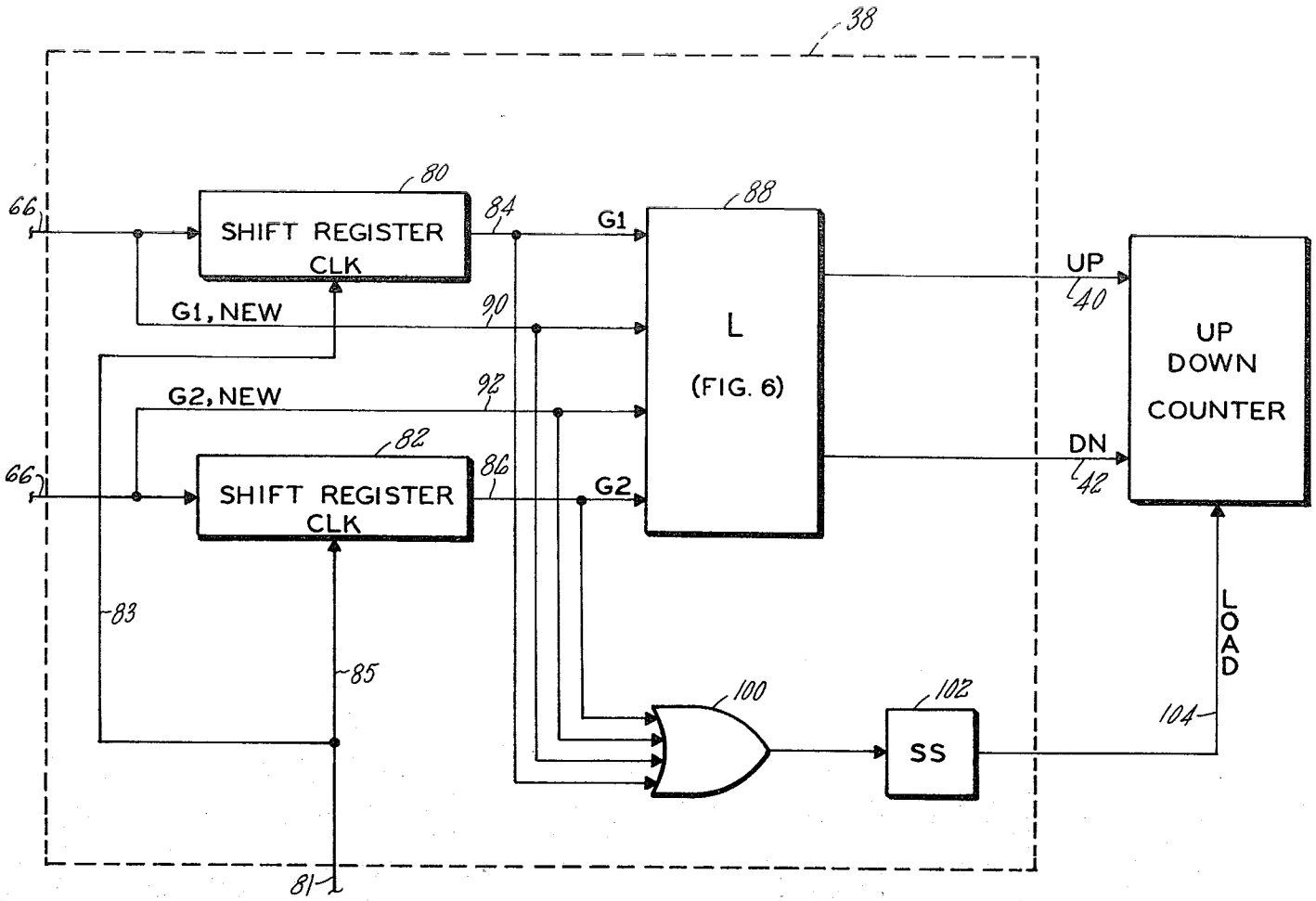
FIG. 4 is a functional block diagram of a decoder subsystem in the system shown in FIG. 1.

Referring to FIG. 4, the decoder 38 includes two shift registers 80, 82. Each shift register receives the gate signal from its corresponding detector over the line 36. The gate signal is clocked into each shift register 80, 82 on each clock pulse on a line 81 from the clock 59 supplied to the registers of corresponding lines 83, 85. The gate signal for each camera is thus stored serially in its corresponding shift register. After one complete scan of each gate, each shift register 80, 82 will contain a "gate signature" comprising the gate signals resulting from that scan. As the next successive scan is made, the signature is unloaded serially from each shift register over lines 84, 86 to a logic circuit 88. During unloading the oldest portions of the signature are unloaded first. The logic circuit also receives the new incoming gate scan signals over lines 90, 92. The newest gate signals and oldest signature portion correspond to the same portions of the scan. Therefore, on the beginning of a second scan of each gate G1, G2 the gate scan signals for identical portions of the gates generated on successive scans are applied to the logic circuit 88. The waveforms C, D, E and F in FIG. 2 illustrate the gate signals supplied to the logic circuit after two complete scans. The logic circuit 88 compares the incoming serial gate signals and, in accordance with a truth table shown in FIG. 5, determines whether an object has moved in or out of the area and whether an up or down count should be generated on the lines 40, 42.

The inputs to the logic circuit 88 are also supplied to a gate 100 whose output is supplied over a line 101 to the input of a monostable (SS) 102. The gate 100 output goes high when any one of the input lines to the logic unit 88 is high. This triggers the single shot which generates a pulse having a duration of several clock pulses. This pulse is supplied over the load line 104 to the up/-down counter and activates the counter for the duration of the pulses. The up/down counter consequently responds only to the up or down count signals on the lines 40, 42 after a delay, and, as a result, the up/down count reflects the comparison made by the logic circuit 88 in a "window" 105 shown in FIG. 2.

This window is important because it prevents incorrect counts from movement along the perimeter. Such movement causes the gate signals to shift in the signature, producing a shift (not shown) in the leading edges 108 of the gate signals on successive scans. If the up or down count is generated from a comparison at the edges, such movement will register as a count. Hence, by counting only in the window area 105, which is intermediate in the gate signals, those effects are avoided.

Figures 5, 6:
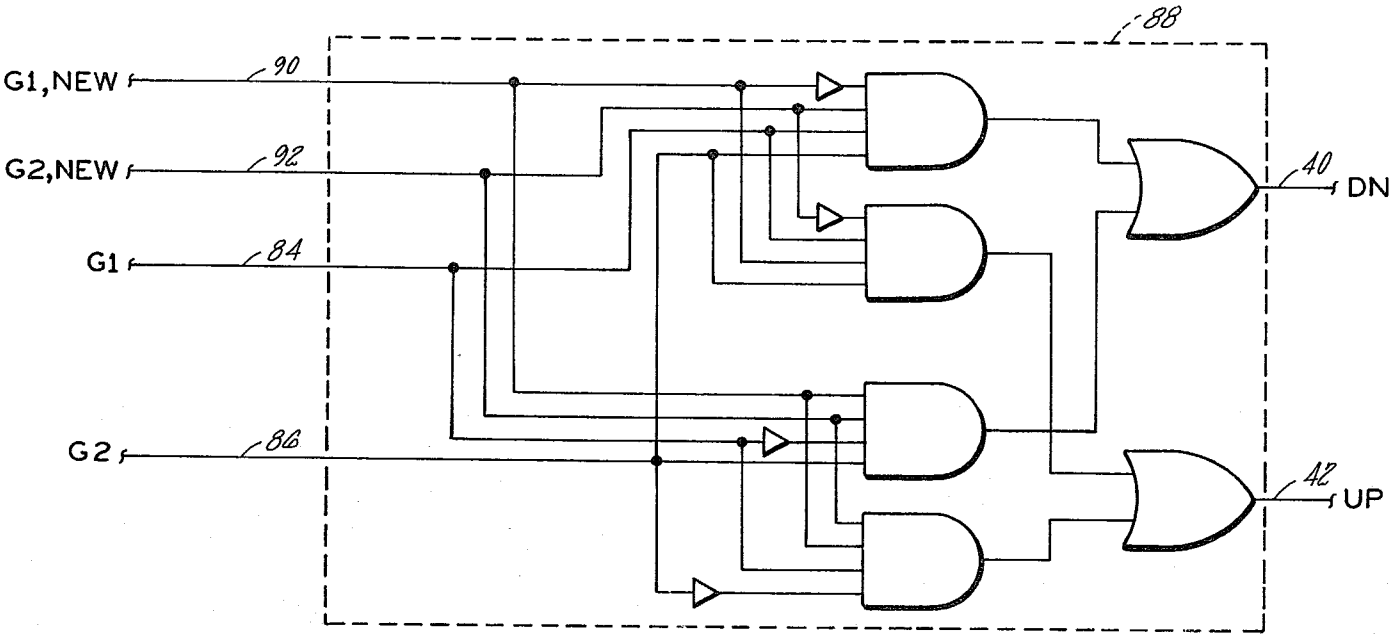
FIG. 5 is a truth table of the functional operations performed by a logic circuit in the decoder system.
FIG. 6 is an electrical schematic diagram of the logic circuit.

As shown in FIG. 6, the logic circuit 88 may consist of discrete components interconnected as shown in order to satisfy the truth table in FIG. 5 for producing an up or down count signal on the lines 40, 42 in response to gate signals supplied, over the lines 84, 86, 90 and 92.

The truth table in FIG. 5 reflects the obvious sequence that takes place when an object or person moves through the gates G1 and G2. As an object first approaches the gates, it will first obscure a portion of gate G1, thus producing a gate signal (i.e. 32). The scans resolve very small movements of objects and people; therefore a gate signal is generated for the gate 1, but is not for the gate 2 as an object or person begins to enter the area. This explains the absence of a signal, in the waveform D, corresponding with the signal 32 in the waveform C. As the object or person continues to move, it will obscure a portion of gate G2, thus producing identical gate signals for both gates: signal 32 in the waveform E and signal 26 in the waveform F. As the object continues to move further, eventually it will move out of gate 1, and the gate signal 32 disappears; the gate signal for the gate 2 will continue to be generated. However, when the object is completely clear of both gates (in the area), a gate signal is not generated for either. This progression is reflected in the truth table in columns 1, 2, 3 and 4. Columns 1 and 4 reflect movement into the area and columns 2 and 3 reflect movement out.

A progression produced by an object moving into the area thus produces two up counts. The up count produced by the conditions in column 1 simply represents the fact that an object has moved into the border. The up count produced in accordance with column 4 simply represents that an object has moved from the border into the area. Thus, two up counts are required to determine that one object has moved through the border into the area. The same is true, but in reverse, for columns 2 and 3, which represent movement out of the area. For simplicity, the counter 44 that is shown will register each up or down count and thus its output is actually twice (count $\times$ 2) the number of objects or people in the area. Quite obviously, a divide by two divider can be connected to the counter output in order to provide the count manifesting the actual number of objects in the area.

Columns 5 and 6 in the truth table do not produce up or down counts because they are not associated with the normal transitions represented by columns 1–4. The transitions in columns 5 and 6 do not allow for determination of the direction of movement; they are therefore rejected by the logic circuit 88, which does not generate an up or down count in response. These are characterized as "too fast" because those transitions can only occur if an object or person should suddenly appear to be on both gates. This can happen only if the movement is so fast that both gates can appear to change in a single scan. Quite obviously, the movement that produces this must be considerably faster than the normal movement of objects and people. One way it can happen is if a person jumps or leaps into the border. By increasing the scan rate, the system's ability to detect the sequence produced by such movement also increases.

The foregoing has described the best mode for carrying out the invention in terms of discrete, hard-wired components. Nevertheless, it will be obvious to one skilled in the art that the invention may be carried out, in whole or in part, through use of computer based systems. For example, a single computer can provide the functions and operations of the detectors 32, the decoder 38 and the up/down counter 44. It might receive the object detection signals from discrete pulse generators and determine if the width of those signals is sufficient to constitute an object to be counted. In synchronism with the scan, a gate signal of predetermined width corresponding to a predetermined floor dimension would be stored in a dynamic memory (RAM), or the actual width and location could be stored. During the next successive scan the new object detection signals could also be stored in the RAM, and a comparison, between the stored signals, could be made bit-by-bit, in accordance with the truth table in FIG. 5, through the use of a lookup table permanently stored in a nonvolatile memory (PROM). Such systems are so flexible that it is also possible to store the old data and withdraw it as the new data is generated in order to conduct a comparison on a serial basis. It is well known, of course, that computer based systems can easily establish and maintain a dynamic up/down count as a function of the output from the lookup table. A computer based system may provide additional flexibility in that the comparison between the gate signatures on successive scans may be made either serially or bit-by-bit in parallel. Obviously, it is important that in either approach the comparison between signatures is made in a window area in order to avoid miscounts. The approach to this described previously is illustrative of the way a computer based system could accomplish this.

The invention has been described in terms of a system for monitoring one border of an area. Quite obviously, other borders can be scanned by other similar systems whose counts may be coupled together in a single counter to provide a count manifesting the number of objects and people within the borders. Alternatively the other borders can be "sketched linearly" by imaging them on a single camera to which all the borders appear as one very long border.

While the foregoing is a description of the best mode for carrying out the invention, it will be obvious to one skilled in the art that modifications, variations, substitutions, in addition to those described, may be made in and to the described best mode, in whole and in part, without departing from the true scope and spirit of the invention embodied therein as described in the claims which now follow.

I claim:

1. An apparatus for counting objects and people in an area, comprising:

means for viewing the area perimeter along an inner and an outer path so that objects and people are seen as they pass over portions of the paths in a sequence manifesting if they are entering or leaving the area, said means generating successive object detection signals for each path, in a sequence that manifests the position of the objects and people and having a duration corresponding to the actual space in the path occupied by the objects and people to which they correspond;

means for generating a path signature for each path from its corresponding object detection signals, said signature consisting of sequential gate signals that manifest a gate area of predetermined space along each path at the location therein of an object or person occupying a minimum predetermined path space;

means for comparing successive path signatures in a manner for detecting changes in successive gate signals according to a predetermined sequence that manifests the sequential movement associated with an object or person passing through adjacent corresponding spaces in the inner and outer paths to enter or leave the area; said means generating, from said comparison, an up count signal each time there is movement across said corresponding path spaces in a direction entering the area and a down count each time there is movement in a direction leaving the area; and a counter, responsive to said up and down count signals, for maintaining a net count that reflects the instantaneous number of people and objects in the area.

2. An apparatus according to claim 1 wherein said means for generating said path signature comprises:

means for comparing the length of each object detection signal with a reference manifesting said predetermined gate area and generating a first object signal each time the length of an object detection signal equals said reference; and means responsive to said object signal for generating said gate signal.

3. An apparatus according to claim 2 wherein:

said means for comparing object detection signals comprises a shift register in which said gate signals are successively loaded at predetermined intervals, thereby producing a shift register word comprising a plurality of bits, each corresponding to a position along a path and means for generating said object signal in response to a shift register word containing a minimum number of bits reflecting the presence of an object occupying the floor position corresponding to an object or person of said minimum size; and said means for generating said gate signal comprises means for generating a predetermined number of pulses in succession in response to said object signal.

4. An apparatus according to claim 1 wherein said means for comparing successive path signatures comprises means for generating said up count signal at a first time the gate signals indicate that an object or person is covering adjacent portions of each path and at a subsequent time they indicate that the object or person covers only said portion of the inner path, and generating said down count signal if at said subsequent time said object or person is covering only said adjacent portion of the outer path.

5. An apparatus according to claim 4 wherein, said means for comparing successive path signatures comprises means for generating said up count signal if in a successive pair of gate signatures a gate signal appears only in the signature corresponding to said inner path, and generating a down count if in said successive pair a gate signal appears only in the signature for the outer path.

6. A method for counting objects and people in an area comprising the steps:

viewing the area perimeter along an inner and an outer path in a manner for observing objects and people as they move across portions of each path in a sequence, between successive time intervals, manifesting the direction of their movement;

generating a signature for each path at each successive time interval, said signature identifying the portion of the path occupied by an object or person;

detecting changes occurring between signatures generated at different intervals, said changes manifesting the changes in the portions occupied by objects and people as they move through the paths when entering and leaving the area; and counting the objects and people in the area by counting the number of times a change is detected that manifests an object entering the area, counting the number of times an object or person is detected as leaving the area and reducing said first number by said second number.

* * * * *